United States Patent [19]

Nishimura

[11] 4,050,673

[45] Sept. 27, 1977

[54] TWO-MASTED LIFTING APPARATUS

[75] Inventor: Matsuo Nishimura, Tokyo, Japan

[73] Assignee: Yasui Sangyo Col. Ltd., Japan

[21] Appl. No.: 749,364

[22] Filed: Dec. 10, 1976

[30] Foreign Application Priority Data

Sept. 17, 1976 Japan ..... 51-110864
Oct. 21, 1976 Japan ..... 51-125540

[51] Int. Cl.[2] ..... B66F 7/12
[52] U.S. Cl. ..... 254/89 H
[58] Field of Search ..... 254/47, 89 R, 89 H; 187/8.41, 8.74, 8.75, 9

[56] References Cited

U.S. PATENT DOCUMENTS

| | | | |
|---|---|---|---|
| 2,593,635 | 4/1952 | Walker | 254/89 H |
| 2,975,560 | 3/1961 | Leonard | 254/89 H |
| 3,327,997 | 6/1967 | Zenke | 254/89 R |

*Primary Examiner*—Al Lawrence Smith
*Assistant Examiner*—Robert C. Watson
*Attorney, Agent, or Firm*—Zarley, McKee, Thomte, Voorhees & Sease

[57] ABSTRACT

A two-masted lifting apparatus particularly adapted to lift a weighty object such as a vehicle or the like to a desired height and then incline it at a desired angle in either direction. The two-masted lifting apparatus comprises two opposing upright masts on each of which a carriage for supporting the object is slidably mounted and a height-difference detecting means. Both carriages are independently hoisted up or down along the respective masts by separate driving means, and the height-difference detecting means is adapted to detect the height-difference between the two carriages and restrict the further ascent or descent of one of the two carriages when the height difference between them has reached a predetermined limit.

6 Claims, 6 Drawing Figures

TWO-MASTED LIFTING APPARATUS

Figure 1:
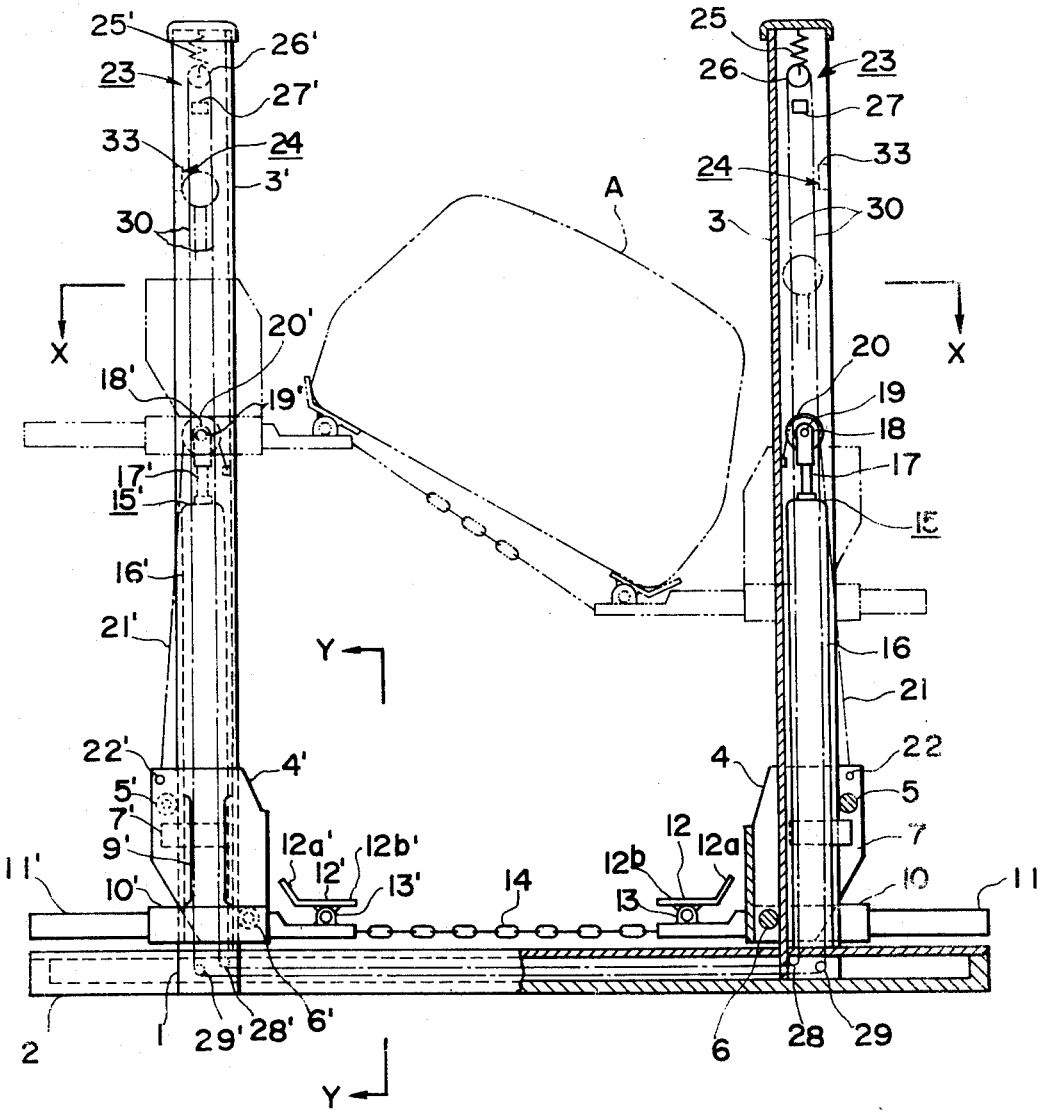

The present invention generally relates to two-masted lifting apparatus for lifting a weighty object such as a vehicle or the like, and more particularly relates to a two-masted lifting apparatus of the kind in which it is possible to lift up a vehicle or the like to a desired height with its original posture maintained and then incline it at a desired angle in either direction; whereby inspecting, repairing or cleaning works upon the underside of the vehicle or the like can be carried out with much ease and safety.

There have heretofore been proposed various kinds of two-masted lifting apparatus. One of the typical two-masted lifting apparatus is one which is capable of inclining a vehicle or the like at a desired angle after lifting it up to a certain height, thereby enabling persons to work easily and safely under the vehicle for inspecting or repairing. The lifting apparatus of this prior art comprises two opposing upright masts on each of which a carriage having a pair of supporting means is slidably mounted. Both carriages, each independently driven by separate driving means, are associatively connected with each other by a chain so that the actuation of one of the two driving means effects the synchronous lifting of both carriages while the actuation of the other administers only the lifting of one of the two carriages to incline the horizontallylifted vehicle.

One of the difficulties in this prior art, though advantageous at least over other lifting apparatus of the similar type, is that it is not possible to incline the vehicle in both directions: i.e., the inclining direction of the vehicle is restricted to only one direction. Accordingly, in order to incline it in the opposite direction, the vehicle has to be dismounted from the lifting apparatus to change its front and then the whole operation has to be started again.

Another difficulty of the prior art is that there is not provided a safety means — if any, the structure will be very complicated — for controlling the maximum admissible inclination angle of such weighty objects to prevent their possible slippage from the apparatus.

The present invention therefore aims at overcoming the above and other difficulties of the prior art by providing a new and improved two-masted lifting apparatus, simple and reliable in structure and cheap in manufacturing cost, which is adapted not only to lift up a weighty object such as a vehicle or the like to a desired height but also to incline it at a desired angle in either direction.

According to one aspect of the two-masted lifting apparatus of the invention, there are provided separate driving means adapted to hoist up or down two carriages independently of each other along the respective upright masts and a height-difference detecting means adapted to detect the height difference between the two carriages and, according to the detected value, restrict the further ascent of one carriage which is higher than the other or restrict the further descent of one carriage which is lower than the other so as to prevent a lifted object from slipping off.

The height-difference detecting means comprises a pair of pulleys each suspended by a tension spring at the upper portion of each mast, a pair of limit switches each secured to the mast slightly below the pulley, an endless wire extending around the two pulleys via suitable guide pulleys rotatably mounted on the lower portion of the masts, and two stoppers secured to the wire. The endless wire is partly secured to the carriage mounted on one of the two masts, and the two stoppers are firmly but removably attached to one of vertically extending portions of the wire so as to get into contact with the upper or lower surface of the carriage mounted on the other mast when a predetermined height difference arises between the two carriages.

Figure 2:
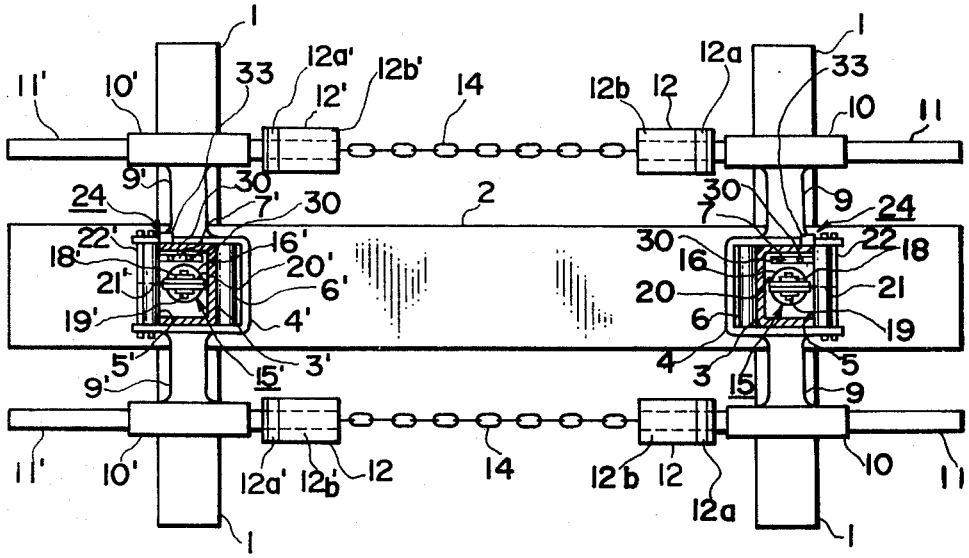
Figure 3:
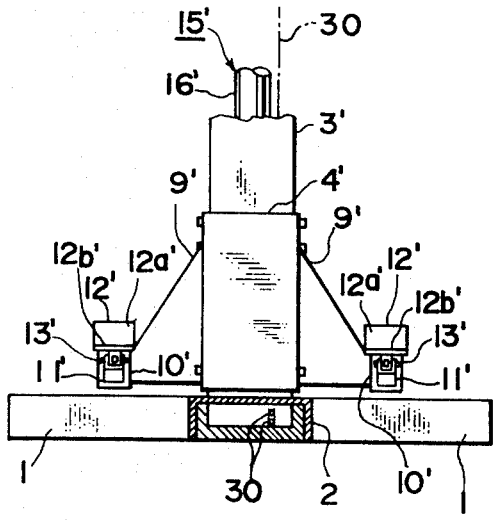
Figure 4:
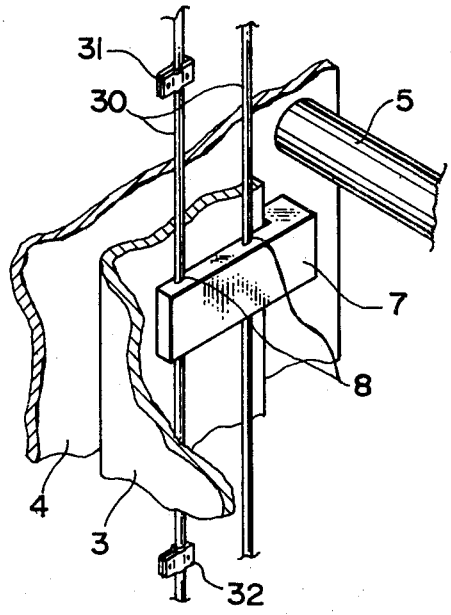
Figure 5:
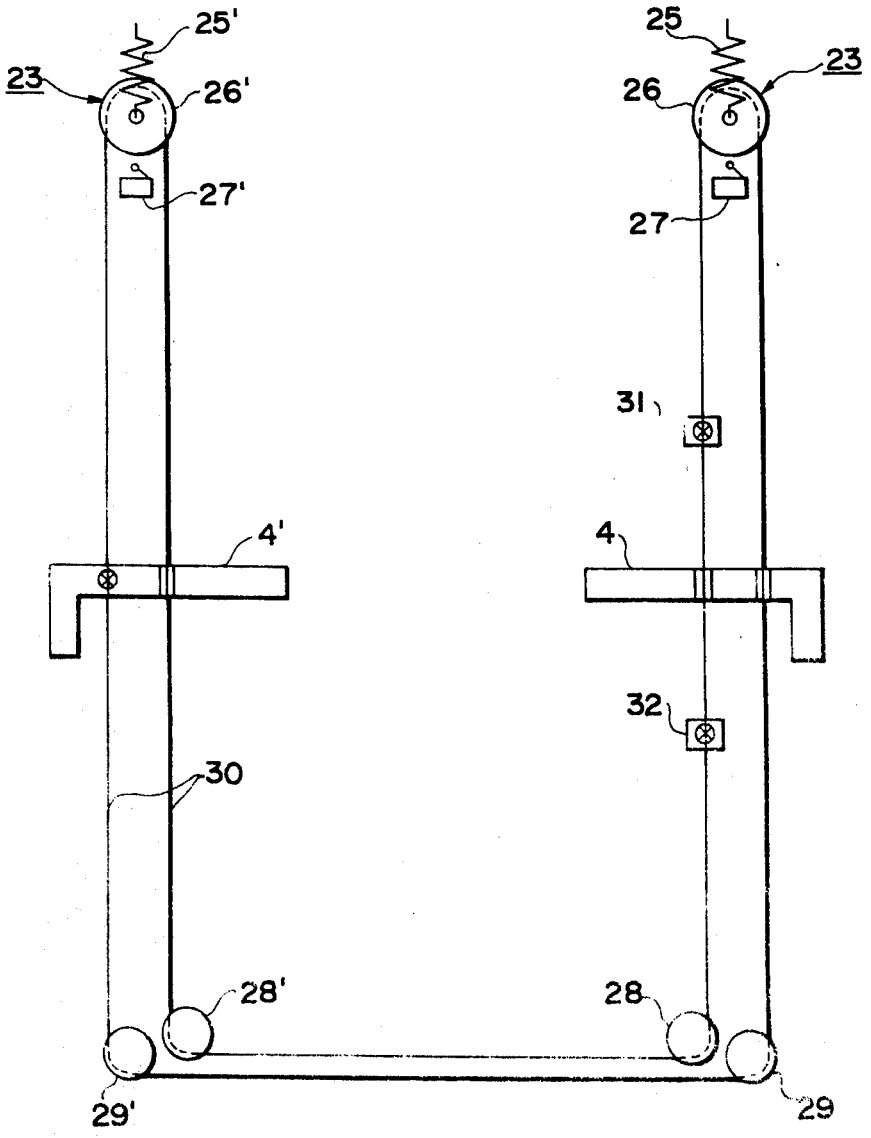
Figure 6:
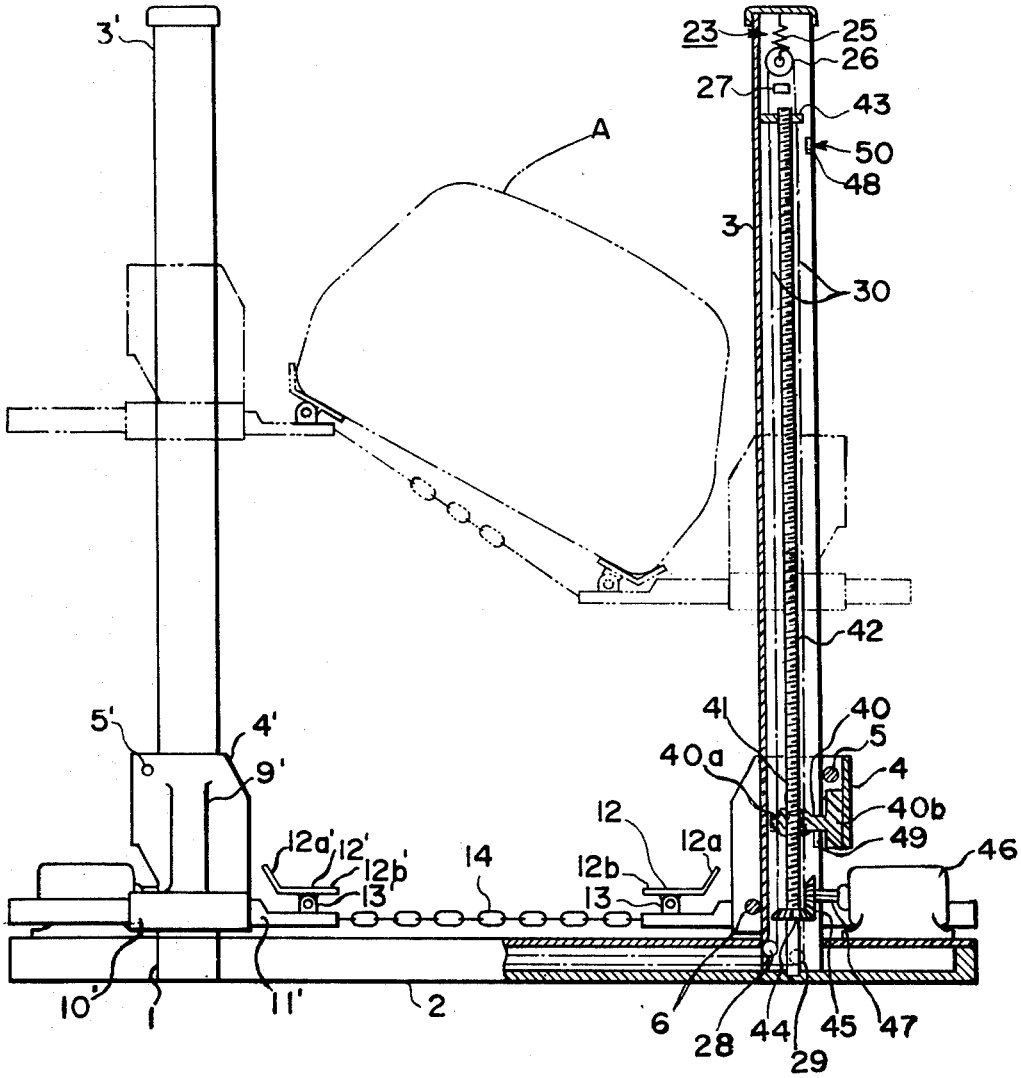

The present invention will now be described in detail, by way of example, with reference to the accompanying drawings, in which;

FIG. 1 is a front view of a two-masted lifting apparatus according to the present invention with its right-hand part illustrated in longitudinal section, FIG. 2 is a transverse sectional plan view, when taken along the line X — X of FIG. 1, FIG. 3 is a longitudinal sectional side view, when taken along the line Y — Y of FIG. 2, FIG. 4 is an enlarged detail showing the attachment of a cantilever plate, FIG. 5 is a schematic illustration of a height-difference detecting means, and FIG. 6 is a front view of an alternate embodiment of a two-masted lifting apparatus according to the present invention with its right-hand part illustrated in longitudinal section.

Referring first to FIGS. 1 to 3, there is shown a base 2 having forewardly and rearwardly projecting supporting wings 1. A pair of upright masts 3 and 3' of substantially channel section are vertically disposed on the base 2 in such a manner that the connected portions of channel-shaped masts 3 and 3' face each other. On each mast 3 or 3', a carriage 4 or 4' or channel section is slidably mounted such that its opened portion faces innerward. Each carriage 4(4') is provided with two horizontal rollers 5(5') and 6(6') at its upper outer portion and lower inner portion respectively. These rollers 5(5') and 6(6'), rolling over the side surfaces of each mast 3(3'), facilitates the smooth sliding up or down of the carriage 4(4') along the mast.

As is best shown in FIG. 4, a cantilever plate 7 or 7' of substantially L-shape is secured at its bottom end to the inner surface of one of the lateral walls of each carriage 4(4'). The cantilever palte 7(7'), the free portion of which protrudes into the open space defined by walls of the mast 3(3') along one of the lateral walls of the mast, is provided with two longitudinally extending bores 8(8').

With particular reference to FIG. 3 showing the left-hand part of the apparatus of the invention, the carriage 4'(4) is provided on its both lateral walls with two brackets 9'(9), to each of which a hollow sleeve 10'(10) of square section is firmly secured at a right angle with respect to the bracket 9'(9). A supporting arm 11'(11) is slidably inserted into each of the hollow sleeves 10 and 10'. A step 12'(12), comprising a base portion **12*b*'(12*b*) and a side wall 12*a*'(12*a*) making an obtuse angle with the base portion 12*b*'(12*b*), is pivotally supported on the upper surface of the inner end portion of the supporting arm 11'(11) through a pin-coupling 13'(13). Removably installed between the inner ends of the two opposing arms 11 and 11' is a chain 14, so that the distance between the two opposing arms is always kept constant even when the two carriages 4 and 4'** have been hoisted to a different height.

According to this invention, the hoisting up or down of each carriage 4(4') is effected by a piston-cylinder device of the fluid pressure type 15(15') which is disposed on the base 2 and extends upwardly through the open space in each mast 3(3'). As can be seen in FIG. 1, a piston 17(17') adapted to reciprocate within a cylinder 16(16') of the piston-cylinder device 15(15') has on the top thereof a bifurcate bearing member 18(18') on which a pulley 20(20') is rotatably supported by a horizontal pin 19(19'). Extended around each pulley 20(20') is a chain 21 (21'), whose one end is fixed to the almost central portion of the mast 3(3') and whose other end is anchored at the carriage 4(4') by a pin 22(22').

Thus, it will readily be understood that each carriage 4(4') can be hoisted up or down independently along the mast by reciprocal motions of the piston 17(17') through the chain 21(21').

There is further provided, according to this invention, a control means for controlling the actuation of the aforementioned piston-cylinder devices 15 and 15', the means comprising height-difference detecting means 23 and a pair of height-restricting means 24. The detecting means 23 is adapted to detect the height difference between the two carriages 4 and 4' and, according to the detected value, restrict the further ascent of one carriage which is higher than the other or restrict the further descent of one carriage which is lower than the other.

On the other hand, the pair of height-restricting means 24, each disposed on the upper portion of mast 3 or 3', are adapted to detect whether the carriage 4 or 4' has climbed up to a desired position and restrict the further ascent thereof from that position independently of the above detecting means 23.

As can best be seen in FIG. 5, the height-difference detecting means 23 comprises a pair of pulleys 26 and 26'suspended by tension springs 25 and 25', a pair of limit switches 27 and 27' secured to the upper portion of the masts 3 and 3'slightly below the pulleys 26 and 26', two pairs of guide pulleys 28, 28', 29 and 29' each rotatably mounted on the lower portion of the mast, an endless wire 30 extending around these pulleys 26, 26', 28, 28', 29 and 29' and penetrating the cantilever plate 7 and 7' through bores 8 and 8', and two stoppers 31 and 32 both attached to one of the vertically-extending portions of the endless wire 30. As shown in FIG. 5, both of stoppers 31 and 32 are attached in a spaced-relationship to a vertically extending portions of the wire 30 where the wire penetrates through the inner bore 8 of the right-hand cantilever plate 7, whilst the wire 30 is secured to the left-hand cantilever 7' at its outer bore 8'.

With the foregoing descriptions in mind, attention will now be directed to the operation of the two-masted lifting apparatus of this invention, and in particular how the height-difference detecting means 23 works will be explained in detail with reference to FIG. 5.

As has been described immediately above, since the endless wire 30 is partly secured to the cantilever plate 7' of the left-hand carriage 4', it travels around pulleys together with the upward or downward movements of the carriage 4'. The two stoppers 31 and 32 are attached to the right-hand part of the wire 30 in such a manner that when both carriages 4 and 4' are same in height the right-hand carriage 4 can be located exactly at the mid point of the distance between the two stoppers 31 and 32. Accordingly, in so far as both carriages 4 and 4' are hoisted up or down by piston-cylinder devices 15 and 15' at the same time and same speed, the location of the right-hand carriage 4 is maintained at the mid point of the two stoppers.

In case a height difference arises between two carriages 4 and 4'; for instance, in case the left carriage 4' is hoisted up higher than the right carriage 4, a vertical portion of the wire 30 where two stoppers 31 and 32 are installed moves upward by the amount equal to the height difference between the two carriages 4 and 4'. In other words, the displacement amount of both stoppers 31 and 32 is always equal to the ascending amount of the left-hand carriage 4'. After the lower stopper 32 has moved up into contact with the lower portion of the right-hand carriage 4, the further ascent of the left-hand carriage 4' along the mast 3' is substantially prevented by the stopper 32. However, the hoisting operation of the left carriage 4' by a piston-cylinder 15' is further continued until the right pulley 26 suspended by a tension spring 25 is pulled downward by the wire 30 and gets into contact with a limit switch 27 secured to the mast 3 to actuate the latter. In this case, it should be noted that, in the strict sense of the word, the left carriage 4' does not stop ascending the instant the stopper 32 moves up to contact with the right carriage 4. It continues to move up slightly until the pulley 26 comes down into contact with the limit switch 27.

This limit switch 27, when actuated, is adapted to halt instantly the further ascent of the left carriage 4' and the further descent of the right carriage 4 as well, so as to prevent the left carriage 4' from ascending beyond a predetermined height difference with respect to the right carriage 4.

On the other hand, another limit switch 27 fixed to the left mast 3' has a similar function, being adapted to immediately halt the further descent of the left carriage 4' and the further ascent of the right carriage 4 to prevent the left carriage 4' from descending beyond a predetermined height difference when the upper stopper 31 contacts the upper portion of the right carriage 4.

It will thus be understood that the height difference between the two carriages 4 and 4' is always restricted within a predetermined range by the height-difference detecting means 23, and fear can totally be eliminated of a lifted vehicle's slippage from steps 12 mounted on supporting arms 11 even if it is inclined. It is of course feasible to adjust a maximum height difference between the two carriages by changing the installation position of stoppers as desired.

In the meantime, each of the pair of height-restricting means 24 comprises a limit switch 33 or 33', which, being secured to the upper portion of the respective 3 or 3', is adapted to stop at once the supply of fluid pressure to the piston-cylinder device 15 or 15' when the carriage 4 to 4' touches the limit switch 33 or 33'; thereby restricting the further ascent of each carriage independently of the aforementioned height-difference detecting means 23.

From the above descriptions thus far made, it will be seen that each carriage 4 or 4' is hoisted up or down independently of each other by the piston-cylinder device 15 or 15' within a range defined by the height-difference detecting means 23 and height-restricting means 24, and that it therefore becomes possible to incline at a desired angle a vehicle or the like, which has been horizontally lifted up to a desired height, with no fear of slipping accidents.

In FIG. 6, similar to FIG. 1, showing an alternative embodiment of the present invention, reference numerals are indicative of the same members as in FIGS. 1 to 5 if same. According to the alternative embodiment, a carriage 4(4') of channel section is secured to each mast 3(3') such that its opened portion faces innerward. A horizontal bar 40, comprising a lateral portion 40*a* traversing the open space of the mast and a base portion 40*b*, is secured to the inner surface of the carriage's outer wall. The lateral portion 40*a* of the bar 40 has a threaded bore 41 excavated at an almost central part thereof and two smaller bores 8, similar to those in FIG. 4, through which a wire 30 of a height-difference detecting means 23 penetrates. From this it will be understood that the horizontal bar 40 performs the same function as that of the cantilever plate 7(7') shown in FIG. 4.

According to this alternative embodiment of the invention, the hoisting up or down of each carriage 4 or 4' is effected by a threaded rod 42 or 42' vertically mounted within each mast 3 or 3'. This threaded rod 42(42'), being adapted to threadably fit in with the threaded bore 41(41') of the bar 40(40'), is rotatably supported at its lower end on the base 2 and at its upper end by a bearing plate 43(43') secured to the upper portion of the mast 3(3'). Each of the threaded rods 42 and 42' is provided at its lower portion with a bevel gear 44(44'), which is engageable with another bevel gear 45(45') extending from a reversible motor 46(46') via a rotary shaft 47(47'). A turning force from the motor 46(46') in either direction is transmitted through the shaft 47(47') and two bevel gears 44(44') and 45(45') to the threaded rod 42(42'), by which each carriage 4 or 4' can be hoisted up or down independently.

Similarly to the first embodiment of the invention, the inclining of a horizontally lifted-vehicle A or the like at a desired angle is controlled by a height-difference detecting means 23 having two limit switches 27 and 27', and the prevention of each carriage from the further ascending or descending beyond a predetermined limit is effected by two limit switches 48(48') and 49(49') fixed to upper and lower portions of each mast respectively.

Thus, it will clearly be understood that the two-masted lifting apparatus of the present invention, whose structure is simple and reliable, is most suited to inspecting, repairing or cleaning works of a vehicle's underside or the like.

What we claim is:

1. A two-masted lifting apparatus particularly adapted to lift up a weighty object such as a vehicle or the like to a desired height and incline said lifted object at a desired angle, said apparatus comprising: a base, a pair of upright masts disposed on said base and opposing each other, a first carriage slidably mounted to one of said masts, a second carriage slidably mounted to the other of said masts, a pair of driving means adapted to hoist up or down said carriages independently of each other along the respective masts, supporting arms for supporting the object to be lifted, each supporting arm being slidably supported on the carriage so as to be movable toward or away from the opposing mast, and a height-difference detecting means adapted to detect the height difference between said carriages and restrict the further ascent or descent of one of the two carriages when the detected height difference between the two carriages has reached a predetermined limit.

2. A two-masted lifting apparatus as claimed in claim 1, wherein said height-difference detecting means comprises;

a pair of pulleys each suspended by a tension spring at the uppermost portion of each mast, a pair of limit switches each secured to the mast slightly below each of said pulleys, an endless wire extending around the two pulleys and guide pulleys rotatably mounted on the lower portions of the masts, a portion of said wire being secured to one of the two carriages, and two stoppers firmly but removably attached to one of the vertically extending portions of said endless wire so as to get into contact with the upper or lower portion of the other carriages when the height difference between the two carriages has reached a predetermined limit.

3. A two-masted lifting apparatus as claimed in claim 1, wherein each of said pair of driving means is a piston-cylinder device of the fluid pressure type which is vertically disposed in parallel with the respective mast and whose force is transmitted to each carriage through a suitable connecting means.

4. A two-masted lifting apparatus as claimed in claim 1, wherein each of said driving means comprises a threaded rod vertically disposed in parallel with the respective mast and threadably engageable with the carriage and a reversible motor adapted to rotate said threaded rod in either direction; thereby hoisting up or down the two carriages independently of each other.

5. A two-masted lifting apparatus as claimed in claim 1, further including connecting means installed between said two opposing supporting arms so as to keep the distance between them constant even when a height difference arises between the two carriages.

6. A two-masted lifting apparatus as claimed in claim 1, further including a pair of limit switches, said each limit switch being disposed on the upper portion of the mast and adapted to restrict the further ascent of the carriage beyond a predetermined height limit.

* * * * *